US005315734A

United States Patent [19]

Kresse et al.

[11] Patent Number: 5,315,734

[45] Date of Patent: May 31, 1994

[54] MOP HEAD COMPRISING A HOLDER INSERTION AID

[75] Inventors: Franz Kresse, Hilden; Rainer Osberghaus, Duesseldorf; Bernfrid Scheller, Pulheim, all of Fed. Rep. of Germany

[73] Assignee: Henkel Kommanditgesellschaft auf Aktien, Duesseldorf, Fed. Rep. of Germany

[21] Appl. No.: 969,189

[22] PCT Filed: Aug. 3, 1991

[86] PCT No.: PCT/EP91/01462

§ 371 Date: Feb. 21, 1993

§ 102(e) Date: Feb. 21, 1993

[87] PCT Pub. No.: WO92/03083

PCT Pub. Date: Mar. 5, 1992

[30] Foreign Application Priority Data

Aug. 14, 1990 [DE] Fed. Rep. of Germany ..... 4925646

[51] Int. Cl.[5] ..... A47L 13/20

[52] U.S. Cl. ..... 15/229.4; 15/229.8

[58] Field of Search ..... 15/223, 224, 226, 228, 15/229.1-229.4, 229.6-229.8, 244.1, 244.2

[56] References Cited

U.S. PATENT DOCUMENTS

| | | | |
|---|---|---|---|
| 4,382,310 | 5/1983 | Moss | 15/229.8 |
| 4,418,524 | 12/1983 | Ito et al. . | |
| 4,715,081 | 12/1987 | Welch | 15/229.8 |
| 4,961,242 | 10/1990 | Kresse et al. | 15/228 |

FOREIGN PATENT DOCUMENTS

| | | | |
|---|---|---|---|
| 2551678 | 2/1977 | Fed. Rep. of Germany . | |
| 3809279 | 6/1989 | Fed. Rep. of Germany . | |
| 1056318 | 10/1953 | France | 15/229.8 |
| 2035064 | 6/1980 | United Kingdom . | |
| 1604448 | 12/1981 | United Kingdom . | |

*Primary Examiner*—Harvey C. Hornsby
*Assistant Examiner*—Mark Spisich
*Attorney, Agent, or Firm*—Ernest G. Szoke; Wayne C. Jaeschke; Daniel S. Ortiz

[57] ABSTRACT

The invention is a mop head having holder insert pockets. The holder insert pockets have thick strips of a water-absorbing and swellable material in the region of the pocket openings.

18 Claims, 2 Drawing Sheets

MOP HEAD COMPRISING A HOLDER INSERTION AID

FIELD OF THE INVENTION

This invention relates to a mop head for the wet or damp cleaning of floors consisting of an elongate textile support layer with holder insertion pockets arranged on top and at either end thereof and material arranged underneath in the form of tufts, fringes, loops, sponge cloth strips or the like for taking up dirt and moisture.

Mops of the type in question are used for cleaning floors. To this end, the mop head is fitted onto holders, the ends of the holders being inserted into the holder insertion pockets. The holders comprise a handle so that the holders with the mop head fitted thereto can be conveniently guided across the floors to be cleaned.

RELATED ART

One mop head of the type in question, in which the holder insertion pockets can be formed from a sheet-form textile material, is known from DE-PS 3 809 279. However, in this mop head, the holder can only be inserted into the holder insertion pockets if they are open. However, since the mop heads are frequently squeezed out in mangles to remove water and are also regularly washed and cleaned in washing machines, the pockets do not stand open, but instead lie flat on the textile support layer. To be able to insert the holder, the pockets first have to be opened by hand.

Another mop head, in which the holder insertion pockets are made of plastic, is known from DE-OS 37 37 414. This mop head is also attended by the disadvantages mentioned above.

To remedy the situation, other known mop heads comprise reinforcements in the form of concealed stiff plastic strips or the like in the region of the pocket openings. These reinforcements are sewn into the holder insertion pockets.

However, reinforcements of the type in question have a number of disadvantages. Firstly, they present problems when the mop heads are squeezed out in mangles because the mop heads frequently jam between the rollers of the mangle. In addition, where the reinforcing strips are made of plastic, they are often destroyed so that they are unable to perform their function of keeping the insertion pockets open. The known proposals also have disadvantages in regard to the cleaning, i.e. washing, of the mop heads. The stiffened regions are obstacles to the fulling process when the mop heads are washed in washing machines. In addition, the stiff reinforcements and pockets rub on the textile support layer during washing and thus lead to premature destruction of the mop head. The weight of the mop heads to be washed is also increased by the reinforcements because the holder insertion pockets are now heavier. Finally, when the mop heads are dried in dryers, the reinforcements in the form of plastic strips are in danger of deforming under the effect of the relatively high drying temperatures and so are no longer able to perform their function.

DE-PS 31 24 292 describes a swellable twisted combination yarn which is used, for example, in the manufacture of disposable diapers.

The object of the present invention was to provide a solution with which the pockets could be kept open without impairing the other performance properties of a mop head.

In a mop head consisting of an elongate textile support layer with holder insert pockets arranged on the top at both ends thereof and material arranged underneath in the form of tufts, fringes, loops, sponge cloth, strips or the like, the solution provided by the invention is characterized in that the holder insertion pockets comprise 0.5 to 10 mm thick strips of a water-absorbing and swellable material, preferably cellulose fleece, in the region of the pocket openings.

The mop heads come into contact with cleaning liquid in the wet and damp wiping of floors. The cleaning liquid is absorbed by the strips of water-absorbing and/or swellable material, which are dry before use, so that the strips undergo an increase in volume and expand. In this way, the holder insertion pockets are opened or kept open. However, the solution according to the invention, by which the insertion pockets are kept open, is not attended by any of the disadvantages mentioned above. Since the water-absorbing and/or swellable material is elastic, the strips do not interfere with wringing of the mop heads. In addition, when the mop heads are washed, the strips do not impair the fulling process which takes place in washing machines. Nor does the mop head have any stiffened regions which rub on the textile layer and could impair its stability. The pocket material itself is also not in any danger of damage by rubbing or chafing on any sewn-in reinforcements. In addition, the solution provided by the invention does not significantly add to the weight of the mop head.

In one advantageous embodiment of the invention for keeping the holder insertion pockets open, the strips are arranged in such a way that they cover the front edges of the pocket openings and inwardly and outwardly adjoining margins of the holder insertion pockets.

DETAILED DESCRIPTION OF THE INVENTION

Since the holder insertion pockets are normally sewn onto the textile layer, the strips are best attached to the pocket by being sewn to the particular holder insertion pocket.

Finally, in another embodiment of the invention, the pockets are of two-layer construction and a strip in the form of a stick is inserted between the layers on the side of the pocket opening and is optionally sewn to the pocket. In production terms, this has the advantage that the strip can first be inserted between the two layers of the particular pocket and can be fixed there before being subsequently sewn to the pocket.

Figure 1:
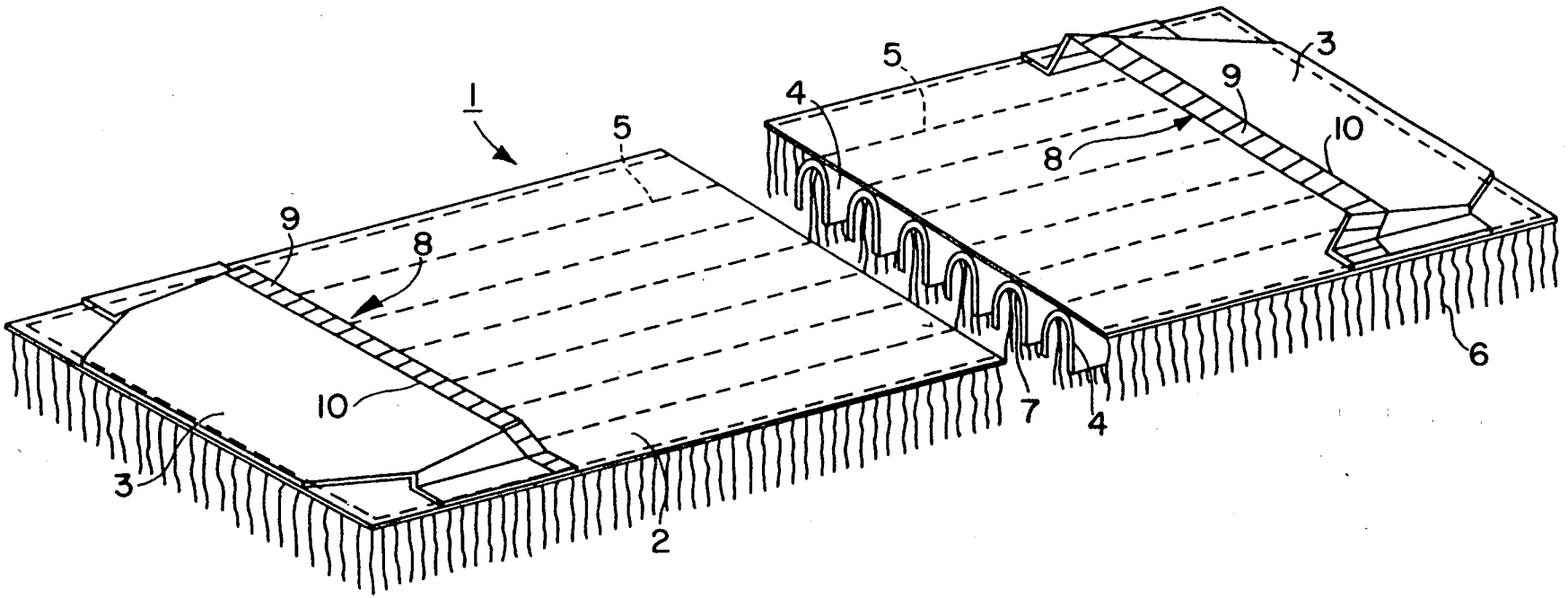
FIG. 1 is a view in perspective and partial section of an embodiment of the invention.

One embodiment of the invention is described by way of example in the following with reference to FIG. 1 of the accompanying drawing which is a view, partly in section, of a mop head according to the invention.

The mop head globally denoted by the reference 1 comprises a textile support layer 2 onto which an insertion pocket 3 for a holder to be inserted therein is sewn at either longitudinal end. The insertion pockets 3 are each preferably in the form of a plastic molding although they may also consist of sheet-form textiles. On its underneath, i.e. on the cleaning-active side, the textile support layer 2 comprises strips 4 of sponge cloth material arranged in rows adjacent one another. The strips 4 are arranged parallel to one another longitudinally of the support layer 2 and are fixed to the support layer 2 locally along lines 5 (chain lines). In addition, fringes 6 are fixed around the outer edge of the textile support layer 2 on the underneath thereof. Fringes 7 are also arranged between the arcuate sponge cloth strips 4.

Figure 2A:
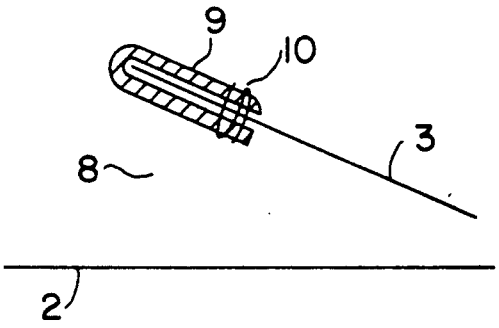
FIG. 2(*a*), (*b*) and (*c*) show in cross-section embodiments of the construction of the pocket in the region of the pocket opening.
Figure 2B:
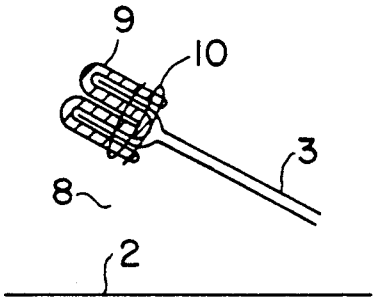
Figure 2C:
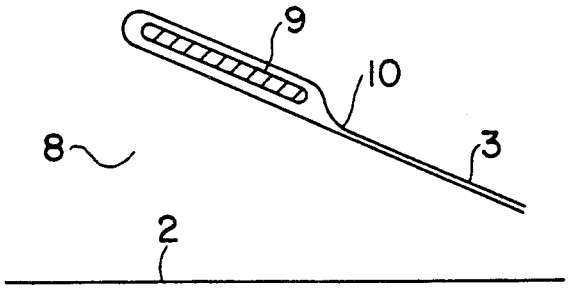

FIG. 2 shows the holder insertion pockets 3 sewn onto the top of the textile support layer 2 comprise strips 9 in the region of the pocket openings 8 for the insertion of the holder. The strips 9 are applied to the front edges of the holder insertion pockets 3 and the inwardly and outwardly adjoining margin of the holder insertion pockets 3. As shown in FIG. 2(*b*) where the strips 9 consist of a water-absorbing and swellable material, preferably a cellulose fleece, and are sewn to the holder insertion pockets 3 along seams 10. As shown in FIG. 2(*b*) where the holder insertion pockets 3 are of two-layer construction, a channel-like insertion opening remains between the two layers of the pocket material from one seam 10 towards the front in the region of the openings 8 of the holder insertion pockets 3. A strip 9 can be introduced into this insertion opening. The dimensions of the strips 9 are preferably such that they project from the channel-like insertion opening and can be folded around the front edges of the two layers of the pocket material and sewn thereto, for example along the seams 10. The strips 9 are between 0.5 and 10 mm thick and preferably 4 mm thick. They have the shape and function of a stick.

As shown in FIG. 2(*c*) the two layers of the holder insertion pockets 3 can also be formed by folding the pocket material in the region of the pocket openings 8 along a fold line to form the front edges of the openings and then sewing it together along the seams 10. In this way, an empty space is formed in the region from the seams 10 to the front edges of the pocket openings 8, a strip 9 being placed on the pocket material in this empty space before the pocket material is folded and sewn. The strip 9 is folded in with the pocket material and, after sewing of the pocket material, is immovably positioned.

We claim:

1. A mop head (1) having a top-side, two ends and an underneath for the wet or damp cleaning of floors comprising an elongate textile support layer (2) with holder insertion pockets (3) with an inside and an outside, having openings with an edge, (8), facing each other, arranged on the top-side and at each end thereof and material (4,6,7) arranged underneath in the form of at least one member selected from the group consisting of tufts, fringes, loops, and sponge cloth strips for taking up dirt and moisture, wherein each holder insertion pocket (3) comprises a 0.5 to 10 mm thick strip (9) of a water-absorbing, swellable and elastic material in the region of the pocket openings (8) whereby the pocket openings are maintained in an open condition when the mop head is wetted.

2. A mop head of claim 1, wherein each pocket edge has an inside and outside margin adjoining the edge wherein the strip (9) covers the front edge of the pocket opening (8) and inside and outside margins of the holder insertion pocket (3).

3. A mop head of claim 2 wherein the strip (9) of water-absorbing, swellable material is sewn to each holder insertion pocket (3).

4. A mop head of claim 3 wherein each holder insertion pocket is of a two-textile layer construction and a strip (9) of the water absorbing, swellable material is inserted between the textile layers adjacent the pocket opening (8).

5. A mop head of claim 2 wherein each holder insertion pocket is of a two-textile layer construction and a strip (9) of water-absorbing, swellable material is inserted between the textile layers adjacent the pocket opening (8).

6. A mop head of claim 1 wherein the strip of water-absorbing, swellable material (9) is sewn to each holder insertion pocket (3).

7. A mop head of claim 10 wherein each holder insertion pocket is of a two-layer textile construction and strip (9) of water absorbing, swellable material is inserted between the textile layers adjacent the pocket opening (8).

8. A mop head of claim 1 wherein each holder insertion pocket is of a two-textile layer construction and a strip (9) of water-absorbing, swellable material is inserted between the textile layers adjacent the pocket opening (8).

9. A mop head of claim 1 wherein the water-absorbing swellable material comprises cellulose fleece.

10. A mop head of claim 9 wherein the strip (9) of water-absorbing, swellable material covers the front edge of the pocket opening (8) and inside and outside adjoining margins of the holder insertion pockets (3).

11. A mop head of claim 10 wherein the strip (9) of water-absorbing, swellable material is sewn to each holder insertion pocket (3).

12. A mop head of claim 11 wherein each holder insertion pocket is of a two-textile layer construction and a strip (9) of the water-absorbing, swellable material is inserted between the layers adjacent the pocket opening (8).

13. A mop head of claim 9 wherein each holder insertion pocket is of a two-textile layer construction and a strip (9) of water-absorbing, swellable material is inserted between the textile layers adjacent the pocket opening (8).

14. A mop head of claim 10 wherein each holder insertion pocket is of a two-textile layer construction and a strip (9) of water-absorbing, swellable material is inserted between the textile layers adjacent the pocket opening (8).

15. A mop head of claim 9 wherein the strip (9) of water-absorbing, swellable material is sewn to each holder insertion pocket (3).

16. A mop head of claim 15 wherein each holder insertion pocket is of a two-textile layer construction and a strip (9) of the water-absorbing, swellable material is inserted between the textile layers adjacent the pocket opening (8).

17. A mop head of claim 1 wherein each holder insertion pocket (3) is of a two textile layer construction having a channel insertion-opening between the two-textile layers of the pocket material, the strip (9) of the water-absorbing, swellable material is arranged in the channel insertion opening and folded around edges of the two textile layers of pocket material and sewn thereto.

18. A mop head of claim 1 wherein each holder insertion pocket (3) comprises an edge of two-layer construction formed by folding the textile pocket material along a fold line to form the front edge of the opening and seaming the pocket material together at a distance from the edge, to form an empty space in the region between the edge and the seam, and the strip of water-absorbing, swellable and elastic material is in the empty space.

* * * * *

UNITED STATES PATENT AND TRADEMARK OFFICE

CERTIFICATE OF CORRECTION

PATENT NO. : 5,315,734

DATED : May 31, 1994

INVENTOR(S) : Kresse et. al.

It is certified that error appears in the above-indentified patent and that said Letters Patent is hereby corrected as shown below:

In claim 7, column 4, line 11, "claim 10", should read:
-- claim 6 --.

Signed and Sealed this

Twenty-fifth Day of April, 1995

*Attest:*

Bruce Lehman

BRUCE LEHMAN

*Attesting Officer*

*Commissioner of Patents and Trademarks*